US006089878A

United States Patent [19]

Meng

[11] Patent Number: 6,089,878

[45] Date of Patent: Jul. 18, 2000

[54] ELECTRICAL CONNECTOR ASSEMBLY HAVING A STANDOFF

[75] Inventor: Ching-Chang Meng, Tu-Chen, Taiwan

[73] Assignee: Hon Hai Precision Ind. Co., Ltd., Taipei Hsien, Taiwan

[21] Appl. No.: 09/198,588

[22] Filed: Nov. 23, 1998

[30] Foreign Application Priority Data

Nov. 24, 1997 [TW] Taiwan ..... 86219640

[51] Int. Cl.[7] ..... H01R 12/20

[52] U.S. Cl. ..... 439/79; 439/74

[58] Field of Search ..... 439/79, 541.5, 439/64, 74

[56] References Cited

U.S. PATENT DOCUMENTS 5,709,568 1/1998 Pan et al. ..... 439/541.5
5,711,679 1/1998 Spickler et al. ..... 439/541.5
5,713,747 2/1998 Hsia et al. ..... 439/541.5
5,775,923 7/1998 Tomioka ..... 439/541.5
5,906,510 5/1999 Lwee ..... 439/541.5
5,954,522 9/1999 Ho et al. ..... 439/541.5
5,967,803 10/1999 Ho ..... 439/79

*Primary Examiner*—Gary F. Paumen

[57] ABSTRACT

An electrical connector assembly comprises a standoff bracket defining a first receiving cell. The standoff bracket defines a mounting face for mounting onto a motherboard. A first connector is received within said first receiving cell. The first connector includes a plurality of contacts and defines a receiving slot for receiving an expansion card therein.

2 Claims, 6 Drawing Sheets

ELECTRICAL CONNECTOR ASSEMBLY HAVING A STANDOFF

FIELD OF THE INVENTION

The present invention relates to an electrical connector assembly, and more particularly to an electrical connector assembly having a first connector and a second connector interconnected to the first connector by means of a third connector.

DESCRIPTION OF PRIOR ART

Conventionally, a receptacle connector having soldering legs is directly mounted onto a motherboard. An add-on or expansion card is then vertically inserted into a receiving slot of the receptacle connector. However, mounting an expansion card vertically onto the motherboard occupies a large space which is undesirable for a computer housing having reduced dimension, such as a notebook computer. In order to meet the compact requirements, the expansion card should be mounted horizontally. As a result, a connector having a horizontal receiving slot is introduced to meet this requirement. Typical connectors are disclosed in Taiwan Pat. Nos. 81102107, 84100686, 84100813, and U.S. Pat. Nos. 4,986,765, 5,004,429, 5,514,002, 5,632,640, 5,639,251, 5,533,901, 5,501,613, 5,468,154, 5,365,408, 5,340,320, 5,342,220, 5,295,483, 5,173,056, 5,161,999, 5,135,405, 4,640,556, 5,037,330, 5,080,609, 5,336,109, 5,401,192, 5,407,336, 5,116,247, 5181,855, 5,277,597, 5,395,250, and 5,478,248. Such connectors can be also referred to as right-angle connectors.

Even if the expansion card is inserted into a receptacle connector along a horizontal direction, a problem still exists. In general, the motherboard is mounted with a plurality of electrical devices and when the expansion card is inserted, at least a space should be provided between the motherboard and the expansion card. Accordingly, the connector shall be provided with certain height to ensure sufficient space between the expansion card and the motherboard.

Normally, the right-angle connector has a plurality of extended terminals bent at 90 degrees. If the terminals are not properly positioned through a spacer, misalignment between the soldering leg and a corresponding mounting hole on a printed circuit board will result.

SUMMARY OF THE INVENTION

An objective of this invention is to provide an electrical connector assembly having a first connector and a second connector interconnected with the first connector by means of a connecting device.

Another objective of this invention is to provide an electrical connector assembly having a standoff bracket for mounting onto a motherboard, whereby an expansion card inserted thereon is spaced apart from the motherboard along a preset direction.

In order to achieve the objectives set forth, an electrical connector assembly in accordance with the present invention comprises a standoff bracket defining a first receiving cell. The standoff bracket defines a mounting face for mounting onto a motherboard. A first connector is received within said first receiving cell. The first connector includes a plurality of contacts and defines a receiving slot for receiving an expansion card therein.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENTS

Figure 1:
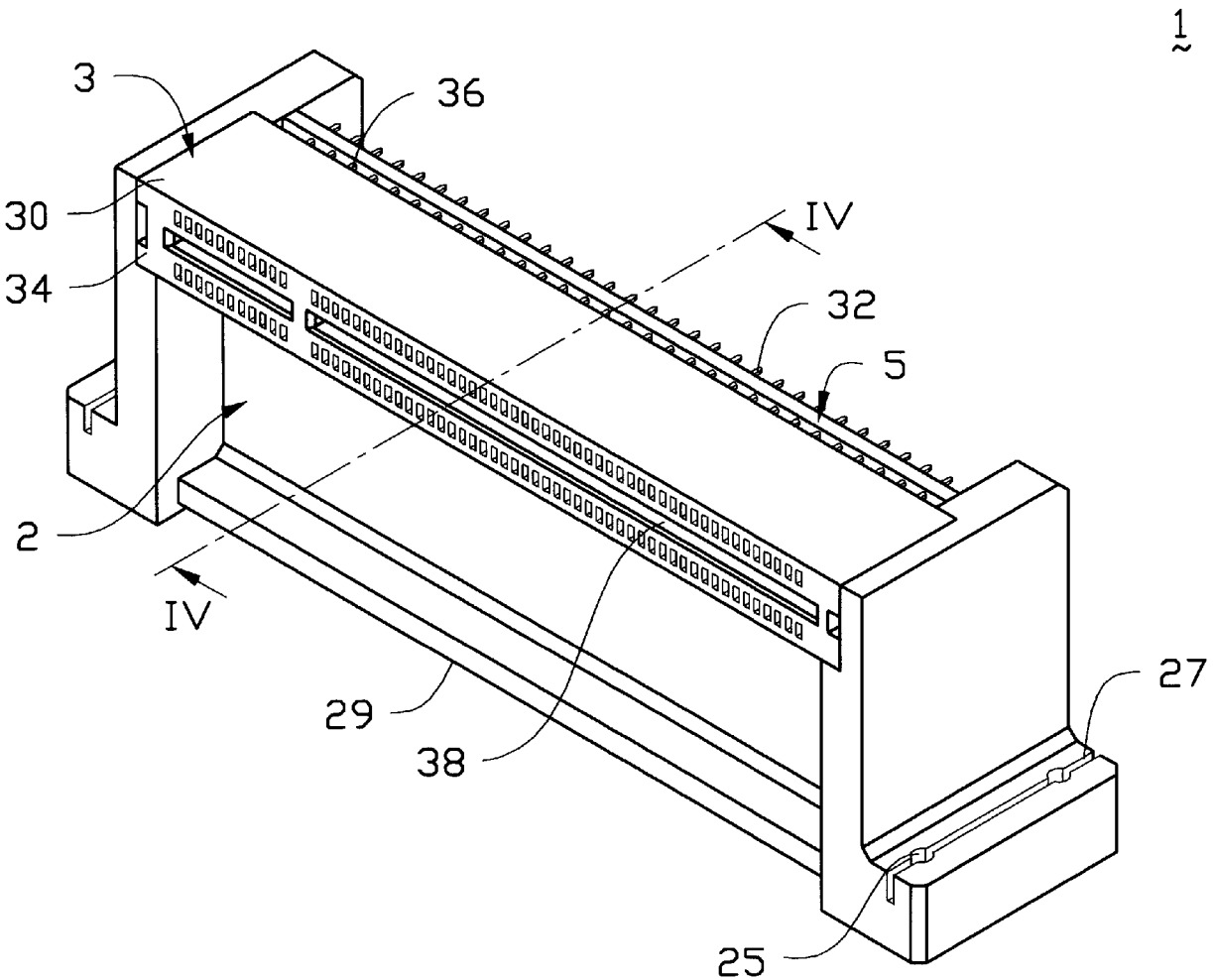
FIG. 1 is a perspective view of an electrical connector assembly in accordance with the present invention.
Figure 2:
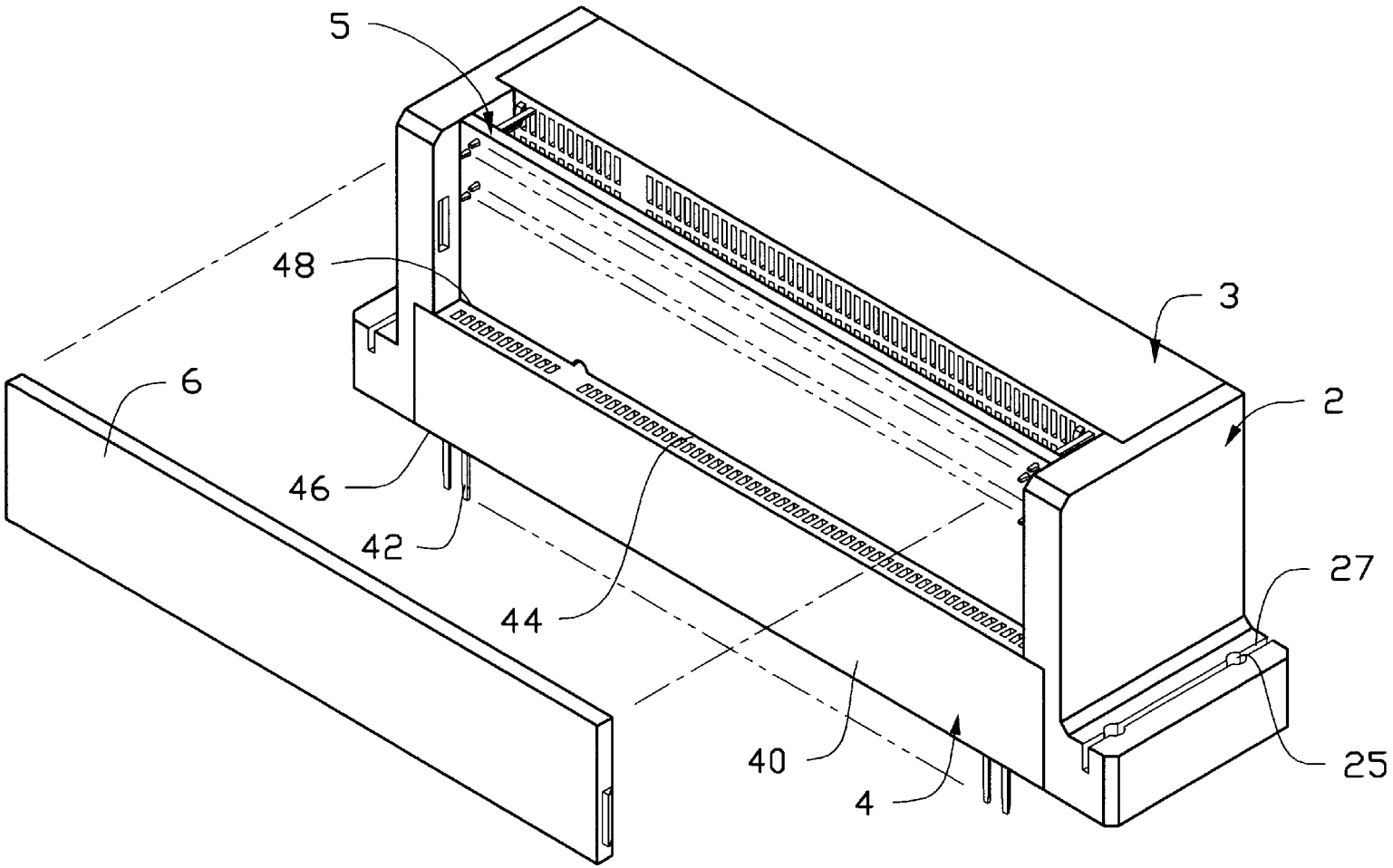
FIG. 2 is a perspective view of the electrical connector assembly of FIG. 1 viewed from a rear side.

Referring to FIGS. 1 and 2, an electrical connector assembly 1 in accordance with the present invention generally comprises a standoff bracket 2 for mounting onto a motherboard (not shown), a first connector 3, a second connector 4, a printed circuit board 5, and a shielding plate 6.

Figure 3:
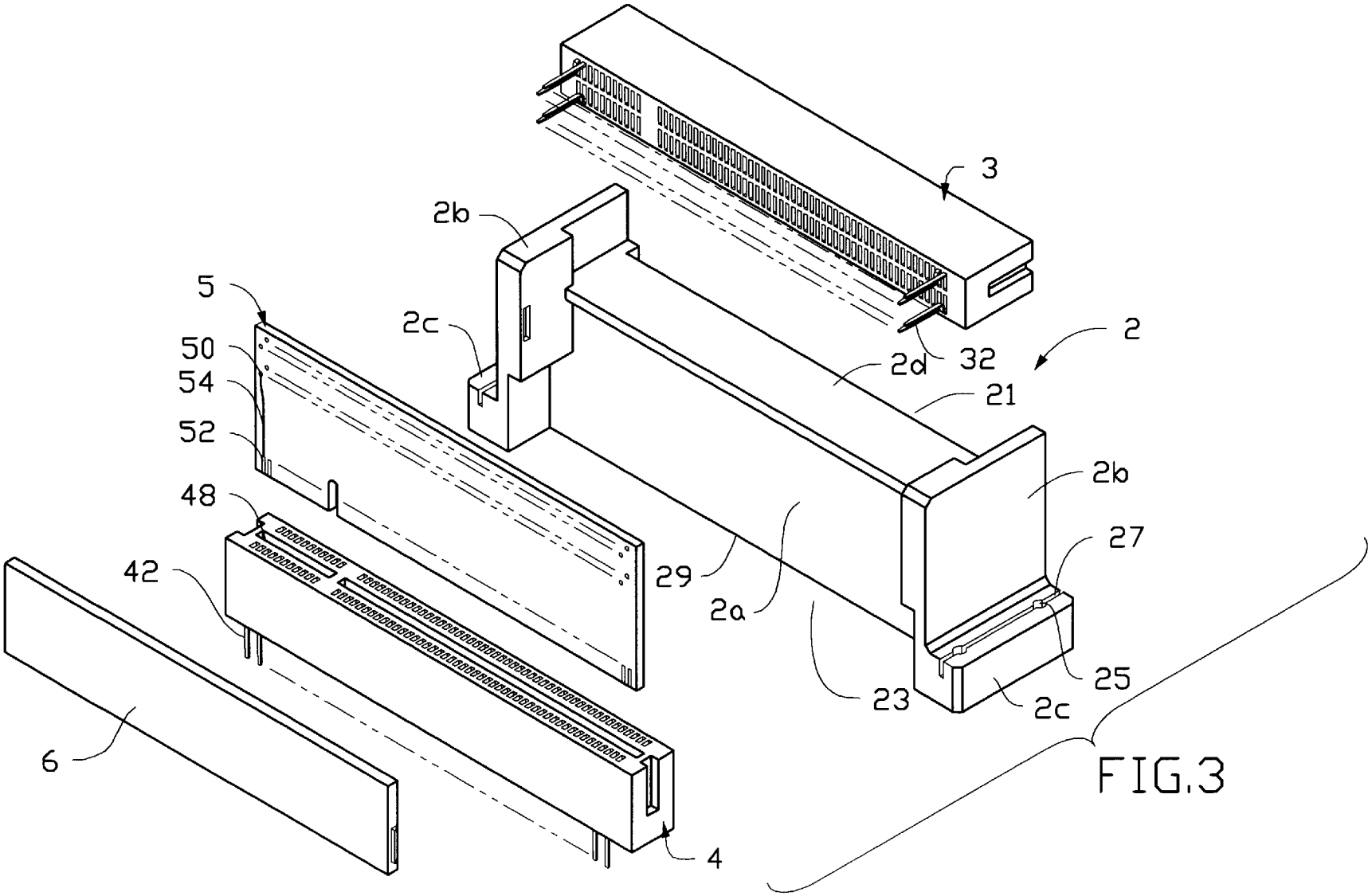
FIG. 3 is an exploded perspective view of the electrical connector assembly of FIG. 1.
Figure 4:
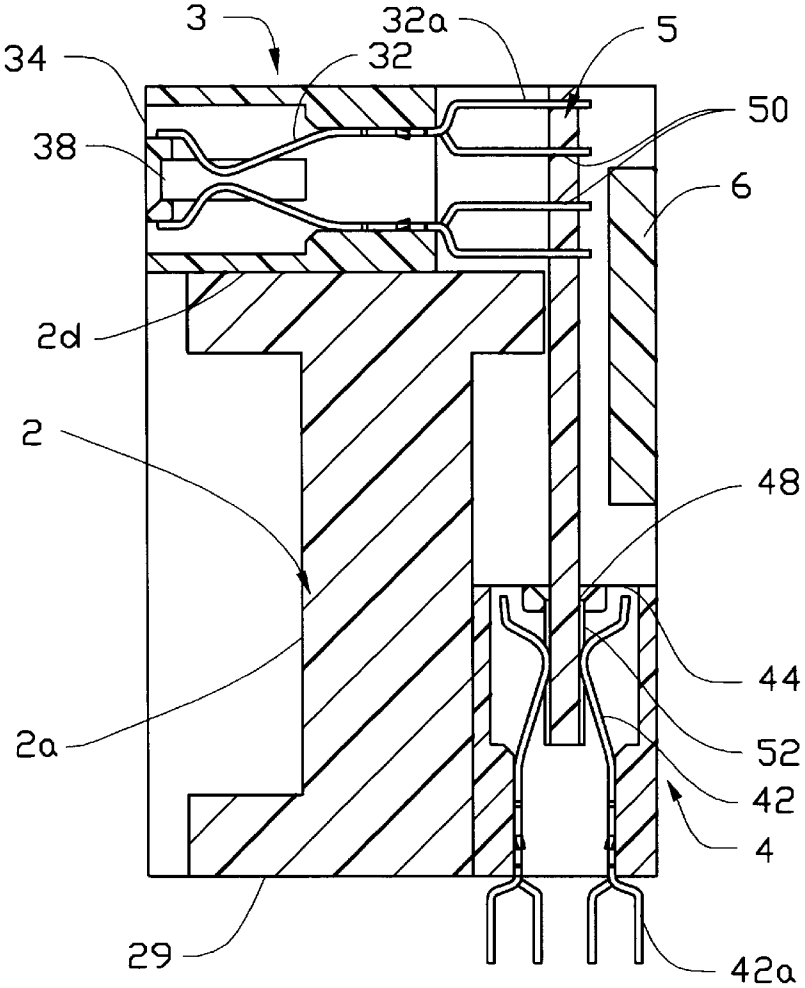
FIG. 4 is a cross sectional view of the electrical connector assembly taken along line IV—IV of FIG. 1.

Referring to FIGS. 3 and 4, the standoff bracket 2 includes a supporting beam 2*a* having a side portion 2*b* at each end. The standoff bracket 2 further includes a wedge 2*c* at each side portion 2*b*. A first receiving cell 21 is defined between an upper face 2*d* and the side portions 2*b*. The standoff bracket 2 defines a mounting face 29 for contacting with an upper face of a motherboard (not shown). The standoff bracket 2 defines a first receiving cell 21 for the first connector 3 and a second receiving cell 23 for the second connector 4. In this embodiment, the first and second receiving cells 21, 23 are orthogonal to each other. The standoff bracket 2 includes a wedge 2*c* on each side thereof. Each wedge 2*c* defines an undercut 27 and a mounting hole 25. Locking screws (not shown) attach the standoff bracket 2 onto the motherboard. The undercut 27 serves to prevent the wedge 2*c* from breaking when the locking screws are applied.

The first and second connectors 3, 4 are card edge connectors having same configuration. Each connector 3(4) includes an insulative housing 30 (40) having a plurality of contacts 32(42) arranged therein. Each connector 3 (4) defines a mating face 34 (44) and a welding face 36 (46). An elongate receiving slot 38 (48) is defined along the mating face 34(36) for receiving a card therein. Each contact 32 (42) extends beyond the welding face 36(46).

The printed circuit board 5 includes a substrate 5*a* having a plurality of conducting pads 52 form on an edge thereof. Each conducting pad 52 electrically engages with the corresponding contact 32(42). The printed circuit board 5 further includes a plurality of conducting holes 50 defined near an edge opposite the conducting pads 52. Each conducting hole 50 is electrically connected to the corresponding conducting pad 52 by means of a lead 54. Alternatively, the conducting hole 50 can be substituted with a conducting pad 52 and the substrate 5*a* can be flexible.

Referring to FIG. 4, the first connector 3 is horizontally received within the first receiving cell 21 and the second connector 4 is vertically received within the second receiving cell 23, and the first and second connectors 3, 4 are interconnected by the printed circuit board 5. In this embodiment, a welding leg 32*a* of the contact 32 is electrically received within the corresponding conducting hole 50. A welding leg 42*a* can then be inserted into a mounting hole of a motherboard (not shown).

It can be readily appreciated that the receiving slot 38 of the first connector 3 is disposed horizontally and an expansion card (not shown) can be inserted therein. By this arrangement, as the expansion card is disposed horizontally, the overall is reduced. Furthermore, since the standoff bracket 2 provides the electrical connector assembly 1 with a certain height over the motherboard, the expansion card mounted thereon will also be spaced apart from the motherboard.

Still referring to FIGS. 3 and 4, the standoff bracket 2 includes a supporting beam 2*a* having a side portion 2*b* at each end. Each wedge 2*c* of the standoff bracket 2 outwardly extends from the corresponding side portion 2*b*.

Figure 5:
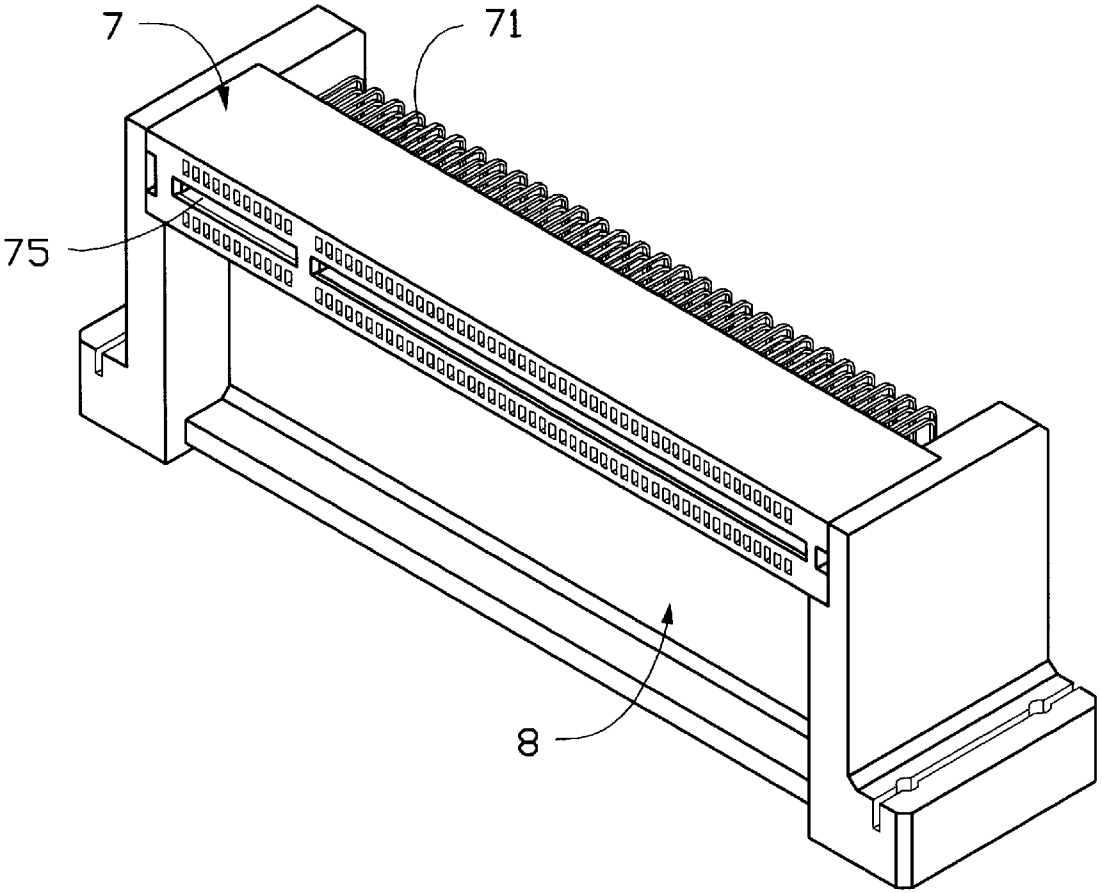
FIG. 5 is a second embodiment of an electrical connector assembly in accordance with the present invention.
Figure 6:
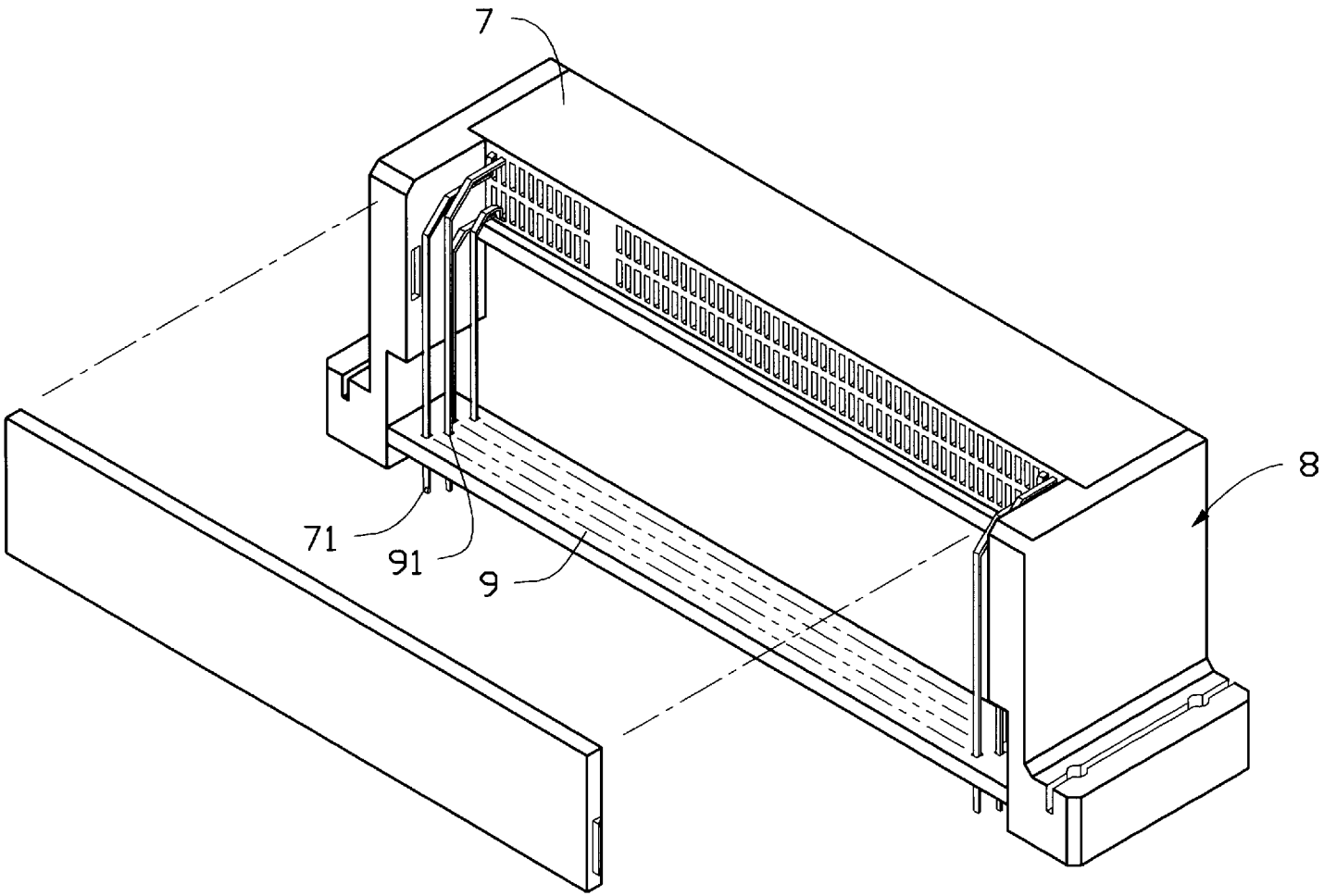
FIG. 6 is a perspective view of FIG. 5 viewed from a rear direction.

Referring to FIGS. 5 and 6, the second connector 4 is omitted in this embodiment and only a first connector 7 is horizontally mounted within a standoff bracket 8. The first connector 7 includes contacts 71 extending beyond the mounting face (not labeled). The first connector 7 defines a first receiving slot 75 for insertion of an expansion card.

The electrical connector assembly 1 further includes a spacer 9 having a plurality of holes 91 forming an array. Each contact 71 is received in the corresponding hole 91 of the spacer 9. By this arrangement, the contact 71 having an extended length will become misaligned with the aligning hole 91.

The first connector 3 and the second connector 4 can be oriented at an angle other than 90 degrees, such as 60 degrees. By this arrangement, the expansion card is disposed at sixty degrees.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, persons of ordinary skill in this field are to understand that all such equivalent structures are to be included within the scope of the following claims.

I claim:

1. An electrical connector assembly, comprising:

a standoff bracket defining a first receiving cell, and a mounting face; and a first connector received within said first receiving cell, said first connector including a plurality of first contacts and defining a first receiving slot for horizontally receiving an expansion card therein;

wherein said standoff bracket further defines a second receiving cell orthogonal to said first receiving cell;

wherein a second connector is vertically disposed within said second receiving cell and includes a plurality of second contacts and a second receiving slot;

wherein said first and second connectors are electrically connected by means of a printed circuit board;

wherein a soldering leg of each second contact is soldered to said printed circuit board;

wherein the soldering leg of each second contact extends beyond a mounting face of said standoff bracket;

further comprising a shielding plate to protect said printed circuit board.

2. An electrical connector assembly comprising:

a standoff bracket defining a first receiving cell and a second receiving cell;

a first connector horizontally received within said first receiving cell; and a second connector vertically received within said second receiving cell;

wherein both of said first and second connectors define corresponding slots, respectively;

wherein said slots of the first and second connectors are adapted to respectively receive corresponding cards, horizontally and vertically;

wherein said first connector and said second connector are electrically connected by the card vertically received within the second connector;

wherein contacts of the first connector are soldered to the card vertically received within the second connector.

* * * * *